US007272948B2

(12) United States Patent
Taras et al.

(10) Patent No.: US 7,272,948 B2
(45) Date of Patent: Sep. 25, 2007

(54) HEAT PUMP WITH REHEAT AND ECONOMIZER FUNCTIONS

(75) Inventors: Michael F. Taras, Fayetteville, NY (US); Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 206 days.

(21) Appl. No.: 10/942,724

(22) Filed: Sep. 16, 2004

(65) Prior Publication Data

US 2006/0053823 A1 Mar. 16, 2006

(51) Int. Cl.
*F25B 13/00* (2006.01)

(52) U.S. Cl. ..... 62/324.1; 62/513

(58) Field of Classification Search ..... 62/173, 62/196.4, 160, 513, 324.1, 159
See application file for complete search history.

(56) References Cited

U.S. PATENT DOCUMENTS

| | | | | |
|---|---|---|---|---|
| 3,264,840 | A | 8/1966 | Harnish | |
| 4,876,859 | A | 10/1989 | Kitamoto | |
| 5,094,085 | A * | 3/1992 | Irino | 62/175 |
| 5,095,712 | A * | 3/1992 | Narreau | 62/113 |
| 5,157,933 | A * | 10/1992 | Brendel | 62/196.4 |
| 5,622,057 | A | 4/1997 | Bussjager | |
| 5,875,637 | A | 3/1999 | Paetow | |
| 5,953,926 | A | 9/1999 | Dressler | |
| 6,055,818 | A * | 5/2000 | Valle et al. | 62/173 |
| 6,206,652 | B1 | 3/2001 | Caillat | |
| 6,276,148 | B1 * | 8/2001 | Shaw | 62/117 |
| 6,381,970 | B1 | 5/2002 | Eber | |
| 6,422,308 | B1 | 7/2002 | Okawara | |
| 6,427,461 | B1 | 8/2002 | Whinery | |
| 6,595,012 | B2 * | 7/2003 | Rafalovich | 62/92 |
| 6,701,723 | B1 | 3/2004 | Dobmeier | |
| 6,705,093 | B1 | 3/2004 | Taras | |
| 6,941,770 | B1 | 9/2005 | Taras | |
| 2001/0023594 | A1 | 9/2001 | Ives | |
| 2003/0136140 | A1 * | 7/2003 | Maeda et al. | 62/271 |
| 2003/0192331 | A1 * | 10/2003 | Alford | 62/173 |
| 2006/0053820 | A1 | 3/2006 | Taras | |
| 2006/0053822 | A1 | 3/2006 | Taras | |
| 2006/0053823 | A1 | 3/2006 | Taras | |

FOREIGN PATENT DOCUMENTS

| | | |
|---|---|---|
| JP | 56061963 | 5/1981 |

* cited by examiner

*Primary Examiner*—Melvin Jones
(74) *Attorney, Agent, or Firm*—Carlson, Gaskey, & Olds

(57) ABSTRACT

A heat pump system operates in heating and cooling modes. The heat pump is provided with both a reheat function and economizer circuit. The economizer circuit provides augmented performance to the heat pump, while the reheat coil allows enhanced control over temperature and humidity of the air supplied to the conditioned space. A bypass line around an outdoor heat exchanger is also provided to achieve additional flexibility of control for a sensible heat ratio. Selective operation of the abovementioned components and subsystems allows precise control over system operation parameters and hence satisfaction of a wide spectrum of sensible and latent load demands and improved reliability.

19 Claims, 3 Drawing Sheets

HEAT PUMP WITH REHEAT AND ECONOMIZER FUNCTIONS

BACKGROUND OF THE INVENTION

This application relates to heat pump refrigerant systems that can be operated in either a cooling or heating mode, and wherein a reheat coil, and an economizer circuit are both incorporated into the system schematic and in combination provide augmented performance and enhanced control.

Refrigerant systems are utilized to control the temperature and humidity of air in various indoor environments to be conditioned. In a typical refrigerant system operating in a cooling mode, a refrigerant is compressed in a compressor and delivered to a condenser (or outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchanges heat with a relatively cold outdoor air. Heat pumps are known as the systems that can reverse the refrigerant flow through the refrigerant cycle in order to operate in both heating and cooling modes. This is usually achieved by incorporating a four-way valve or an equivalent device into the system schematic downstream of the compressor discharge port. The four-way valve selectively directs the refrigerant flow through the indoor or outdoor heat exchanger when the system is in the heating or cooling mode of operation respectively. Furthermore, if the expansion device cannot handle the reversed flow, then a pair of unidirectional expansion devices, each along with the corresponding check valve, is to be employed instead.

In some cases, while the system is operating in the cooling mode, the temperature level, to which the air is brought to provide a comfort environment in a conditioned space, may need to be higher than the temperature that would provide the ideal humidity level. This has presented design challenges to refrigerant cycle designers. One way to address such challenges is to utilize various schematics incorporating reheat coils. In many cases, the reheat coils, placed on the way of indoor air stream behind the evaporator, are employed for the purpose of reheating the air supplied to the conditioned space, after it has been cooled in the evaporator, and where the moisture has been removed.

One of the options available to a refrigerant system designer to increase efficiency is a so-called economizer cycle. In the economizer cycle, a portion of the refrigerant flowing from the condenser is tapped and passed through an economizer expansion device and then to an economizer heat exchanger. This tapped refrigerant subcools a main refrigerant flow that also passes through the economizer heat exchanger. The tapped refrigerant leaves the economizer heat exchanger, usually in a vapor state, and is injected back into the compressor at an intermediate compression point (or in between the compressor stages, in case multi-stage compression is utilized). The main refrigerant is additionally subcooled after passing through the economizer heat exchanger. The main refrigerant then passes through a main expansion device and an evaporator. This main flow will have a higher capacity due to additional subcooling obtained in the economizer heat exchanger. The economizer cycle thus provides enhanced system performance. In an alternate arrangement, a portion of the refrigerant is tapped and passed through the economizer expansion device after being passed through the economizer heat exchanger (along with the main flow). In all other aspects this arrangement is identical to the configuration described above.

If a reheat function is implemented, as known, at least a portion of the refrigerant upstream of the expansion device is passed through a reheat heat exchanger and then is returned back to the main circuit. At least a portion of a conditioned air, having passed over the evaporator for the moisture removal and humidity control, is then passed over this reheat heat exchanger to be reheated to a desired temperature.

Recently, the assignee of this application has developed a system that combines the reheat coil and economizer cycle. However, variations of this basic concept have yet to be fully developed. In particular, the combination and selective operation of the reheat coil and economizer cycle has not been incorporated in heat pump system designs and their applications.

SUMMARY OF THE INVENTION

A heat pump system is operable in either a heating or cooling mode. A flow control device such as a four-way valve routes the refrigerant through the system in the proper direction depending on whether the heat pump is in a cooling or heating mode of operation. A reheat coil selectively receives refrigerant when its functioning is desired, while the system is operating as an air conditioner (or in one of its cooling modes). The reheat coil is operable to heat at least a portion of air, supplied into an environment to be conditioned, to a higher temperature than the temperature obtained in an indoor heat exchanger, where the desired amount of moisture has been removed from the air. Thus, the temperature and humidity of the supplied air closely approximate a desired comfort level for an occupant of the environment.

In addition, the reheat coil can be operable in combination with an economizer circuit. The economizer circuit augments the performance of the heat pump system in a heating mode and in a variety of cooling modes of operation. The combination of an economizer cycle and a reheat coil provides better system control and broader application coverage in terms of temperature and humidity spectra and offers a higher degree of comfort to the occupant of the environment to be conditioned.

In additional embodiments, the heat pump is provided with the ability to bypass a portion or an entire refrigerant flow around the outdoor heat exchanger. By controlling the amount of refrigerant bypassing the outdoor heat exchanger, the sensible heat ratio can be managed and adjusted to a desired value.

In some embodiments, a flash tank is utilized as the economizer heat exchanger in the economizer cycle. Also, it is well understood that a single economized compressor can be replaced by a so-called compressor bank, if it is desired to obtain more unloading steps or a compressor of a required size is not available. Some compressors in the bank may be economized compressors and some conventional compressors. Furthermore, multi-stage or compound cooling (where some cylinders are used as a first stage of compression and the remaining cylinders are utilized as subsequent one or more stages of compression) compression technology can be employed as a direct replacement of a single economized compressor, if preferred.

These and other features of the present invention can be best understood from the following specification and drawings, the following of which is a brief description.

DETAILED DESCRIPTION OF THE PREFERRED EMBODIMENT

Figure 1:
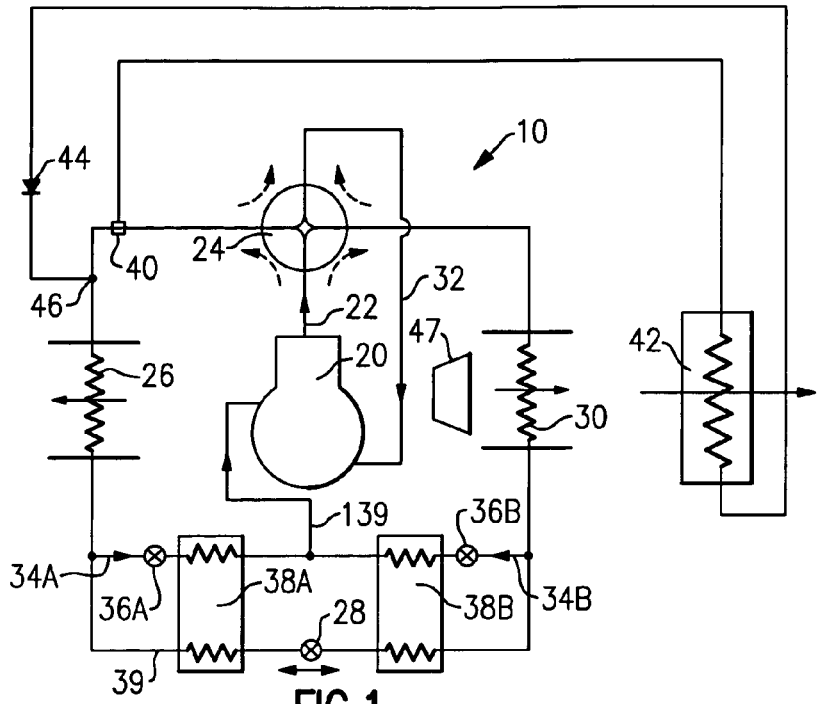
FIG. 1 shows a first schematic of the present invention.

FIG. 1 shows a heat pump schematic 10 wherein a compressor 20 compresses a refrigerant and delivers that refrigerant to a discharge port 22. In a cooling mode, a four-way valve 24 routes the refrigerant to an outdoor heat exchanger 26, then to a main expansion device 28, and then to an indoor heat exchanger 30, from where it is returned through the four-way valve 24 and suction line 32 to the compressor 20. In a heating mode, a direction of the refrigerant flow through the system is essentially reversed, and the refrigerant flows from the compressor 20, through the four-way valve 24, through the indoor heat exchanger 30, main expansion device 28, to the outdoor heat exchanger 26, and then again through the four-way valve 24 and suction line 32 to the compressor 20. This general operation is as known in the art. As can be seen in the FIG. 1 drawing, the four-way valve 24 is controlled to either achieve cooling or heating mode of operation. As was mentioned earlier, if the expansion device cannot handle the reverse flow, then, as one of the potential solutions, a pair of unidirectional expansion devices, with the corresponding check valves, is to be employed instead.

In the heat pump schematic shown in FIG. 1, taps 34A and 34B selectively tap refrigerant from a main refrigerant line 39. The taps 34A and 34B pass the refrigerant through economizer expansion devices 36A and 36B leading into a pair of economizer heat exchangers 38A and 38B. Economizer heat exchanger 38A operates in the cooling mode, while economizer heat exchanger 38B operates in the heating mode. A return line 39 returns the tapped refrigerant to an intermediate port in the compressor 20. In case the economizer expansion devices 36A and 36B cannot be completely closed, a corresponding shutoff valve may need to accompany each expansion device.

When it is desired to have an economized operation in a cooling mode, then the economizer expansion device 36A is open while the economizer expansion device 36B is closed. Refrigerant will now flow through the tapped portion of the economizer heat exchanger 38A and through the main line 39. The flow in the main line 39 will be subcooled prior to reaching the main expansion device 38. While passing through the economizer heat exchanger 38B, the refrigerant will not change temperature, as there will be no refrigerant flow in the tapped portion through the line 34B.

When operating in the heating mode, the economizer expansion device 36B is open while the economizer expansion device 36A is closed. Now, the refrigerant in the main line 39 will be subcooled in the heat exchanger 38B.

In addition, a three-way valve 40 selectively taps the refrigerant to a reheat coil 32. From reheat coil 42, the refrigerant passes through a check valve 44 and returns to the main cycle loop at a point 46. As shown, an air moving device 47 passes air over the indoor heat exchanger 30, and at least a portion of this air over the reheat coil 42 on its way to an environment to be conditioned. The use of the reheat coil 42 allows the air reach a higher temperature than would be achieved in the indoor heat exchanger 30. The indoor heat exchanger 30 can thus cool the refrigerant to a temperature below that in the environment. This allows a significant amount of moisture to be removed from the air. Downstream of the indoor heat exchanger 30, at least a portion of this air passes over the reheat coil 42 where it is re-heated to a desired temperature. In this manner, the reheat coil allows the designer of the refrigerant cycle 10 to have enhanced control over temperature and humidity of the air to be conditioned and delivered to the environment. The reheat coil is particularly useful when utilized in combination with the economizer function. The economizer function not only provides enhanced system performance but allows for better dehumidification to be achieved.

A system control thus operates the economizer expansion devices 36A and 36B, and the three-way valve 40, along with the four-way valve 24 as desired to achieve the varying demands on the heat pump 10 for temperature and humidity levels to satisfy external sensible and latent heat loads. It is to be noted that the reheat coil 42 and the economizer heat exchangers 38A and 38B are in a sequential arrangement with the reheat coil being positioned upstream of them and utilizes hot gas for the reheat function.

Figure 2:
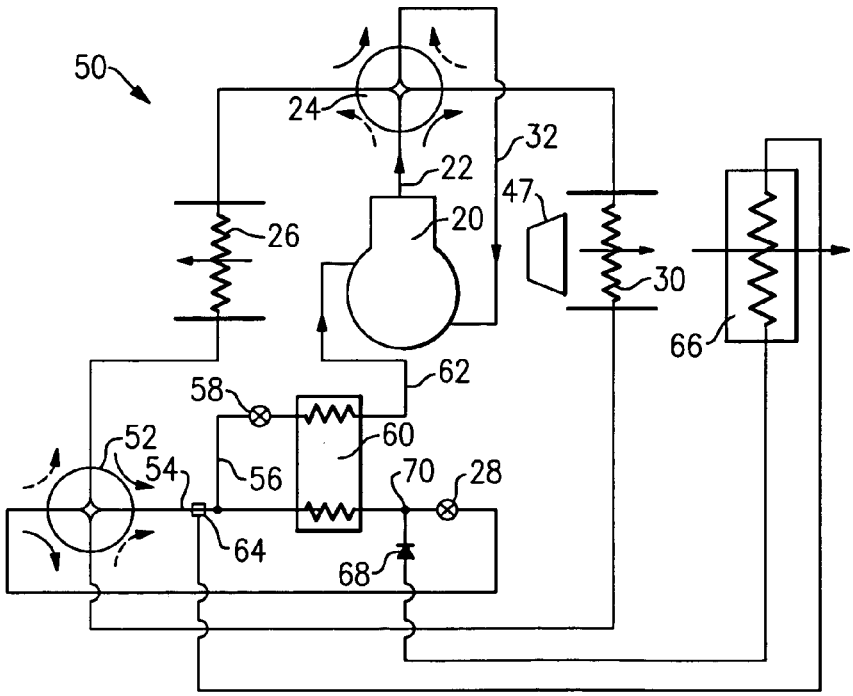
FIG. 2 shows a second schematic of the present invention.

FIG. 2 shows another refrigerant cycle 50 that operates in a similar fashion, with the exception that a second four-way valve 52 routes the refrigerant into a single economizer heat exchanger 60 in both cooling and heating modes of operation. Thus, refrigerant flows through the valve 52 into the line 54, where the economizer flow is directed into a tap line 56, through an economizer expansion device 58, and through the economizer heat exchanger 60. In the economizer heat exchanger 60, the main flow of refrigerant is subcooled by the tapped, economizer flow of refrigerant. The refrigerant from the tap line 56 is returned through line 62 to an intermediate compression point in the compressor 20. Although both the main and economizer flows are illustrated flowing in the same direction in the economizer heat exchanger 60, a counter-flow configuration is preferred for a better heat transfer interaction.

The three-way valve 64 is shown at an intermediate location between the four-way reverse valve 52 and the tap line 56. The refrigerant in the operational reheat circuit passes from the three-way valve 64, through a reheat coil 66, through a check valve 68, and is returned to the main refrigerant circuit at a point 70, intermediate to the economizer heat exchanger 60 and the main expansion device 28. Thus, in this case, the reheat coil 66 employs liquid refrigerant for the reheat function. Additionally, the economizer heat exchanger 60 and the reheat coil 66 are arranged in a parallel configuration. It becomes obvious to a person ordinarily skilled in the art that other locations and arrangements for the reheat coil are also feasible.

The FIG. 2 embodiment provides similar benefits, of better temperature and humidity control, enhanced system performance and higher reliability (due to reduction in start-stop cycles), to the schematic shown in FIG. 1 in both cooling and heating modes of operation.

Figure 3:
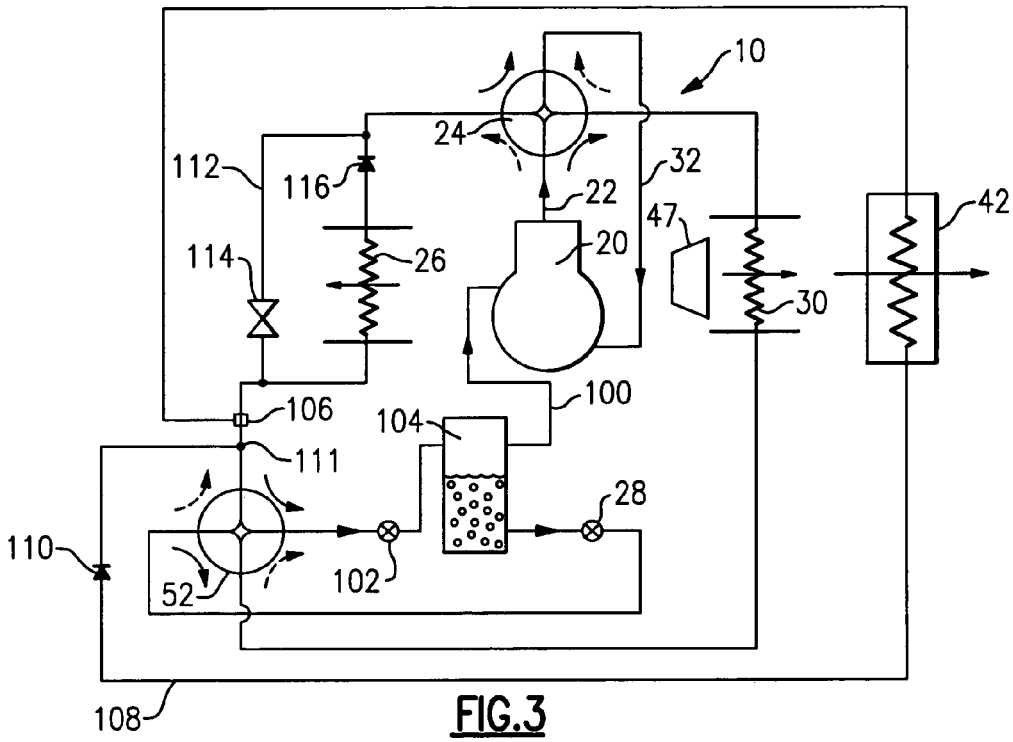
FIG. 3 shows a third schematic of the present invention.

FIG. 3 shows another embodiment that is generally similar to the earlier embodiments. However, a flash tank 104 is utilized in place of the economizer heat exchanger. Flash tanks are known in the provision of economizer circuits, however, they have not been utilized in heat pumps, and certainly not heat pumps with the other aspects of this invention. The flash tank separates a refrigerant having passed through a first expansion device 102, after having been routed from the four-way reverse valve 52. The flash tank 104 separates a vapor component 100, which is returned to the compressor 20, from a liquid. The liquid, separated in the flash tank 104, is routed through a second expansion device 28 to the indoor heat exchanger 30 or to the outdoor heat exchanger 26 in the cooling or heating mode of operation respectively. Another aspect illustrated in this invention is a three-way valve 106 for supplying refrigerant to a reheat coil 42 that is positioned intermediate to the outdoor heat exchanger 26 and the four-way reverse valve 52. A reheat circuit line 108 passes through a check valve 110 and returns refrigerant from the reheat heat exchanger 42 to the main circuit at a point 111 intermediate the three-way valve 106 and the four-way reverse valve 52.

Another control feature provided in this schematic is the ability to bypass the outdoor heat exchanger 26. This ability is valuable when dehumidification is desired with little or no cooling. Thus, the amount of refrigerant flowing through a bypass line 112 is controlled by a flow control devices 114 and 116. For instance, the entire refrigerant flow can be bypassed around the outdoor heat exchanger 26 by shutting the flow control device 116 and opening the flow control device 114. In case, the flow control device 116 is open and the flow control device 114 is closed, the entire refrigerant flow passes through the outdoor heat exchanger 26. In a typical case, some (but not all) of the refrigerant flow will bypass the outdoor heat exchanger 26 and controlling the bypass flow amount allows achieving variable sensible heat ratio and truly independent management of temperature and humidity by providing a required thermodynamic state to the reheat coil 42. It is to be noted that the reheat coil 42 and the flash tank 104 are in a sequential arrangement, with the reheat coil located upstream of the flash tank and is able to utilize hot gas, liquid or two-phase mixture for the reheat function. All the benefits suggested by the teachings of the embodiments shown in FIGS. 1 and 2 are applicable here as well.

Figure 4:
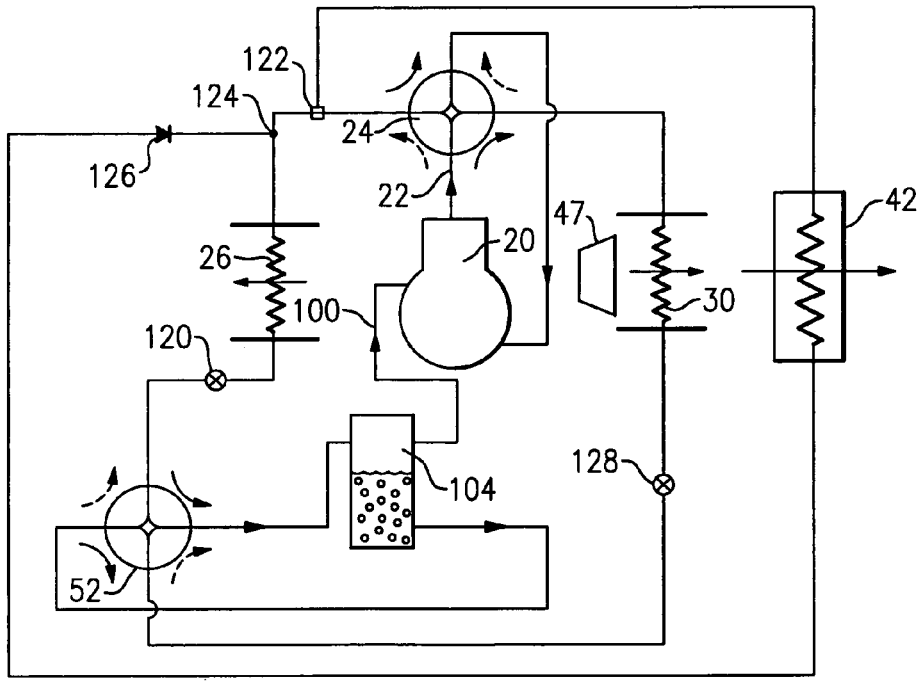
FIG. 4 shows a fourth schematic of the present invention.

FIG. 4 shows another embodiment, wherein the expansion devices 128 and 120 are positioned outwardly of the four-way valve 52. Thus, when the refrigerant cycle is operating in a cooling mode, the expansion device 120 would serve to effectively be similar to the expansion device 102 in the FIG. 3 embodiment. Under such circumstances, the expansion device 128 would be similar to the expansion device 28. However, in a heating mode, the roles of the expansion devices 120 and 128 are reversed.

In this embodiment, a three-way valve 122 serving the reheat loop is positioned intermediate to the four-way valve 24 and the outdoor heat exchanger 26. The return point 124 from the reheat circuit is positioned intermediate to the three-way valve 122 and the outdoor heat exchanger 26. Again, a check valve 126 is incorporated in the reheat circuit. Hot refrigerant vapor is utilized for the reheat function and the reheat coil 42. This embodiment enjoys similar benefits to the schematics described above.

Figure 5:
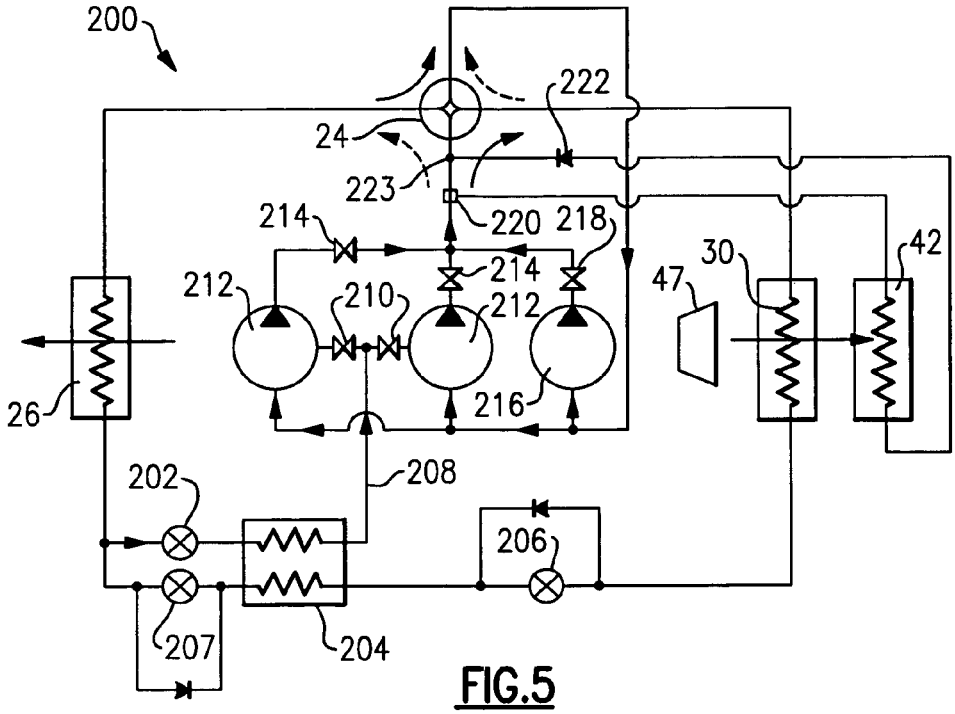
FIG. 5 shows a fifth schematic of the present invention.

FIG. 5 shows another schematic wherein several economized (212) and conventional (216) tandem compressors, having common suction and discharge manifolds, are employed. In schematic 200, the main operation and flow is generally the same as with prior disclosed embodiments. An economizer expansion device 202 is positioned on a tap line, and controls flow through an economizer heat exchanger 204. A main cooling expansion device 206 and a main heating expansion device 207 are located on both sides of the economizer heat exchanger 204. Each expansion device is coupled with a check valve allowing refrigerant flow around it in the mode of operation when that particular expansion device is not utilized. As shown, the main expansion device 207 is not used in the cooling mode of operation and the main expansion device 206 is not employed in the heating mode of operation. The refrigerant flow through the economizer heat exchanger 204 is reversed between cooling and heating modes, and the economizer flow is tapped either upstream (in the cooling mode) or downstream (in the heating mode) of the economizer heat exchanger 204. Such economizer flow configuration, with respect to the location of the tap line on either side of the economizer heat exchanger, can be easily reversed with no significant impact on the system operation and performance. A line 208 returns tapped refrigerant to the intermediate compression ports of the tandem economized compressors 212 (two compressors in this case) through intermediate lines having control valves 210. As is known, this refrigerant is preferably injected back into the compressors at an intermediate point of the compression process in a vapor state. Valves 214 are positioned downstream of the compressors 212 to control the flow of discharged refrigerant toward the four-way reversing valve 24. A conventional compressor 216 (single compressor in this case) obviously is not provided with the returned economizer flow and has its own discharge valve 218. A three-way valve 220 selectively routes refrigerant to a reheat coil 42. A check valve 222 controls the flow of refrigerant back from the reheat coil 42 toward the four-way reversing valve 24, but not in the opposed direction. As shown, this refrigerant re-enters the discharge line at a point 223. It can be noted that the reheat scheme in this embodiment utilizes the hot refrigerant vapor, and the reheat coil 42 and the economizer heat exchanger 204 are arranged in a sequential configuration.

The system schematic in this embodiment operates to provide both the reheat and economizer functions, as described above. However, there are additionally several more levels of control in that each compressor can be operated and controlled independently, and the economized compressors each can be operated with or without the economizer function.

Figure 6:
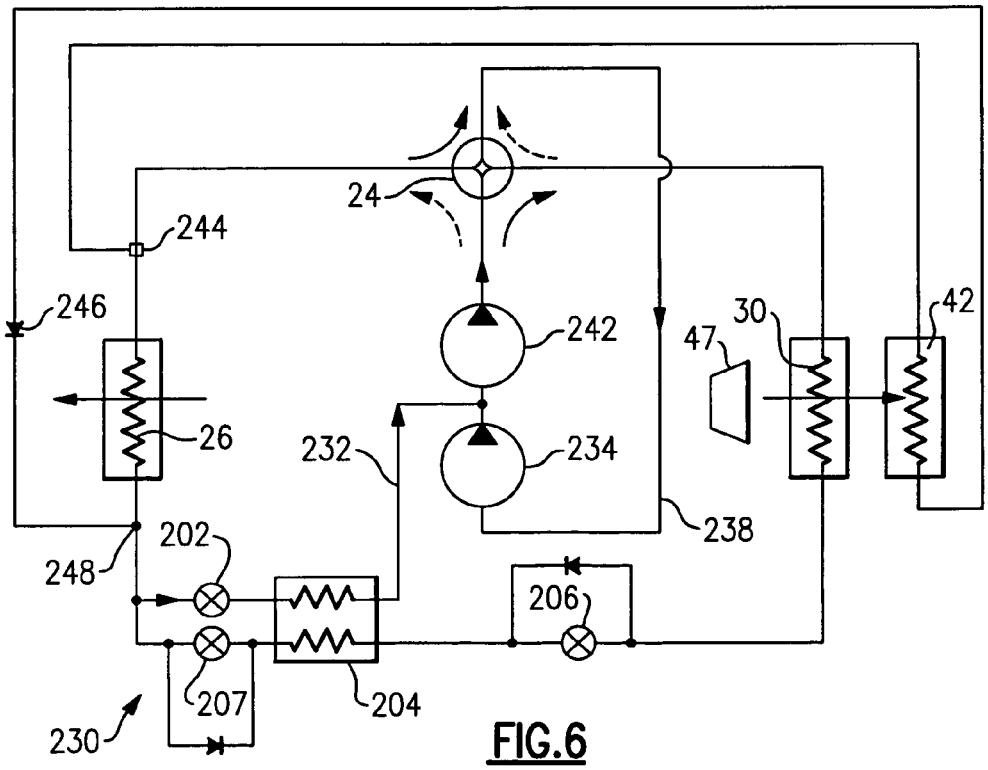
FIG. 6 shows a sixth schematic of the present invention.

FIG. 6 shows yet another embodiment 230. In embodiment 230, rather than tandem compressors, a multi-stage or compound compressor is utilized. As shown, the return line 232 from the economizer heat exchanger 204 passes tapped refrigerant in between the first compression stage 234 and the second compression stage 242. It is known to a person ordinarily skilled in the art that more than to compression stages can co-exist and each compression stage may contain several tandem compressors.

The reheat coil 42 has its three-way valve 234 positioned to tap refrigerant to the reheat coil 42, and the refrigerant returns to the main cycle through the check valve 246 to a point 248. Again, the reheat and economizer functions can be provided as described above. As shown, the reheat scheme in this embodiment utilizes the hot refrigerant vapor. Furthermore, the reheat coil 42 and the economizer heat exchanger are arranged in a sequential manner while the reheat coil 42 and the outdoor heat exchanger 20 are configured in parallel.

With all the embodiments, a worker of ordinary skill in the art would recognize that an appropriate control should be included to control the various valves and components. A worker would know how to provide such a control given the stated goals and objectives of this application.

While several schematics that benefit from the teachings of the invention are shown, it should be understood to a person ordinarily skilled in the art that other schematics and variations in design with respect to locations for the flow control devices (such as four-way reversing valves, three-way valves, solenoid valves, expansion devices, etc.); relative economizer heat exchanger, outdoor heat exchanger and reheat coil configurations; and reheat scheme concepts (hot gas, liquid refrigerant, two-phase mixture) are within the scope of this invention. Consequently, similar benefits regarding independent temperature and humidity control enhancement, performance augmentation and reliability improvement in both cooling and heating modes of operation for the heat pump applications are obtained regardless of the abovementioned design parameters and configurations. The main thrust of this invention is the inclusion and selective operation of a reheat coil in a combination with an economizer function in a heat pump system that is operable in both heating and cooling modes. It should be added that a three-way valve described in the text above can be replaced by a pair of standard ON/OFF valves.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A heat pump system comprising:

at least one compressor, said compressor compressing refrigerant and delivering the refrigerant to a discharge line, said compressor receiving a refrigerant from a suction line;

a flow control device for selectively controlling the flow of refrigerant from said discharge line, and for returning refrigerant to said suction line;

an indoor heat exchanger and an outdoor heat exchanger, said flow control device being operable to send refrigerant from said discharge line to said outdoor heat exchanger, and then to said indoor heat exchanger when in a cooling mode, and operable to pass refrigerant from said compressor discharge line to said indoor heat exchanger and then to said outdoor heat exchanger when in a heating mode; and a reheat coil, said reheat coil being in communication with the refrigerant line to tap a refrigerant through a reheat coil, and return said refrigerant to said refrigerant line, an air moving device for passing air to an environment to be conditioned over said indoor heat exchanger, and at least a portion of said air over said reheat coil;

an economizer circuit, said economizer circuit providing subcooling to a main flow of refrigerant by a tapped flow of refrigerant; and said economizer circuit includes a pair of economizer heat exchangers, with one economizer heat exchanger being dedicated to a heating mode and one being dedicated to a cooling mode.

2. A heat pump system comprising:

at least one compressor, said compressor compressing refrigerant and delivering the refrigerant to a discharge line, said compressor receiving a refrigerant from a suction line;

a flow control device for selectively controlling the flow of refrigerant from said discharge line, and for returning refrigerant to said suction line;

an indoor heat exchanger and an outdoor heat exchanger, said flow control device being operable to send refrigerant from said discharge line to said outdoor heat exchanger, and then to said indoor heat exchanger when in a cooling mode, and operable to pass refrigerant from said compressor discharge line to said indoor heat exchanger and then to said outdoor heat exchanger when in a heating mode;

a reheat coil, said reheat coil being in communication with the refrigerant line to tap a refrigerant through a reheat coil, and return said refrigerant to said refrigerant line, an air moving device for passing air to an environment to be conditioned over said indoor heat exchanger, and at least a portion of said air over said reheat coil;

an economizer circuit, said economizer circuit providing subcooling to a main flow of refrigerant by a tapped flow of refrigerant; and said economizer circuit including a single economizer heat exchanger, and a second flow control device routing refrigerant to said economizer heat exchanger either downstream of said outdoor heat exchanger in a cooling mode, or downstream of said indoor heat exchanger in a heating mode.

3. The heat pump system as set forth in claim 2, wherein a flash tank is utilized as said economizer heat exchanger.

4. The heat pump system as set forth in claim 3, wherein a pair of expansion devices is positioned such that one operates to expand refrigerant heading to said flash tank, and the other operates to expand refrigerant downstream of said flash tank, with the roles of said two expansion devices reversing when the refrigerant system is in a cooling mode and when it is in a heating mode.

5. The heat pump system as set forth in claim 3, wherein a pair of expansion devices is positioned such that one operates to expand refrigerant heading to said flash tank, and the other operates to expand refrigerant downstream of said flash tank, with the roles of said two expansion devices staying the same whether the refrigerant system is in a cooling mode and when it is in a heating mode.

6. The heat pump system as set forth in claim 1, wherein said economizer heat exchanger and said reheat coil are positioned to be in parallel relationship with each other.

7. The heat pump system as set forth in claim 1, wherein said economizer heat exchanger and said reheat coil are positioned to be in serial relationship to each other.

8. The heat pump system as set forth in claim 1 includes tandem compressors connected in parallel.

9. The heat pump system as set forth in claim 1 includes multiple compressors connected in series.

10. The heat pump system as set forth in claim 1 includes a compound compressor.

11. The heat pump system as set forth in claim 1, wherein a bypass line is provided for bypassing refrigerant around said outdoor heat exchanger.

12. The heat pump system as set forth in claim 1, wherein said outdoor heat exchanger and said reheat coil are positioned to be in parallel relationship with each other.

13. The heat pump system as set forth in claim 1, wherein said outdoor heat exchanger and said reheat coil are positioned to be in serial relationship to each other.

14. A method of operating a heat pump system comprising the steps of:

(1) providing a flow control device for routing refrigerant in either a cooling or heating mode, and providing a reheat coil, an indoor heat exchanger positioned to be adjacent said reheat coil, such that at least a portion of air passing over said indoor heat exchanger also passes over said reheat coil, and an economizer circuit; and (2) selectively operating said refrigerant system in one of said heating and cooling modes, and selectively routing refrigerant through said reheat coil to achieve desired temperature and humidity levels when desired, and selectively operating the economizer circuit to provide an economizer function when desired;

(3) the economizer circuit includes a single economizer heat exchanger and a flow control device routing refrigerant to said economizer heat exchanger either downstream of the outdoor heat exchanger in a cooling mode, or downstream of the indoor heat exchanger in a heating mode.

15. The method of claim 14, further comprising the steps of providing a bypass around an outdoor heat exchanger, and selectively bypassing refrigerant around said outdoor heat exchanger to achieve additional control over sensible heat ratio when desired.

16. The method of claim 14, wherein said heat pump system includes tandem compressors connected in parallel, and said control selectively operates said tandem compressors.

17. The method of claim 14, wherein said heat pump system includes multiple compressors connected in series, and said control selectively operates said compressors.

18. The method of claim 14, wherein a compressor utilized with the heat pump system is a compound compressor, and said control selectively operating one or more stages of said compound compressor.

19. A method of operating a heat pump system comprising the steps of:

(1) providing a flow control device for routing refrigerant in either a cooling or heating mode, and providing a reheat coil, an indoor heat exchanger positioned to be adjacent said reheat coil, such that at least a portion of air passing over said indoor heat exchanger also passes over said reheat coil, and an economizer circuit; and (2) selectively operating said refrigerant system in one of said heating and cooling modes, and selectively routing refrigerant through said reheat coil to achieve desired temperature and humidity levels when desired, and selectively operating the economizer circuit to provide an economizer function when desired; and (3) the economizer circuit includes a pair of economizer heat exchangers, with refrigerant passing through one economizer heat exchanger when in a heating mode, and passing through the other economizer heat exchanger when in a cooling mode.

* * * * *